United States Patent [19]

Nishikawa

[11] 3,989,915

[45] Nov. 2, 1976

[54] TOGGLE SWITCH

[76] Inventor: Kikuyoshi Nishikawa, 17, Tsuoka-cho, Asahi, Yokohama, Kanagawa, Japan

[22] Filed: Jan. 3, 1975

[21] Appl. No.: 538,277

[30] Foreign Application Priority Data

Apr. 10, 1974 Japan ..... 49-41522
Jan. 11, 1974 Japan ..... 49-6972

[52] U.S. Cl. ..... 200/67 G; 200/153 G
[51] Int. Cl.[2] ..... H01H 13/18
[58] Field of Search ..... 200/153 G, 67 G, 68, 200/279

[56] References Cited

UNITED STATES PATENTS

| | | | |
|---|---|---|---|
| 1,808,555 | 6/1931 | Ishimaru | 200/279 |
| 2,808,482 | 10/1957 | Zanichkowsky et al. | 200/67 G |
| 3,746,809 | 7/1973 | Gaber | 200/67 G |

*Primary Examiner*—Herman J. Hohauser
*Attorney, Agent, or Firm*—Pollock, VandeSande & Priddy

[57] ABSTRACT

A toggle switch comprises a casing including a bottom plate of an insulating material through which extend a common terminal as well as first and second transfer terminals. A rod-shaped movable contact member is retained on the common terminal intermediate its length for seesaw motion for causing the movable contact member to contact the first and the second transfer terminals alternately. An interposing piece of an insulating material is disposed on the movable contact member and is engaged by a pusher which is resiliently urged toward the terminals and is displaced toward the first or the second transfer terminal relative to the common terminal under the control of operating means. Such operation produces the seesaw motion of the interposing piece and the movable contact member.

7 Claims, 7 Drawing Figures

TOGGLE SWITCH

BACKGROUND OF THE INVENTION

The invention relates to a toggle switch in which a rod-shaped movable contact member is retained for a seesaw motion on a common terminal for selectively contacting either first or second transfer terminals located on the opposite side thereof in response to a switching operation.

A conventional toggle switch comprises a blade-shaped movable contact member which is resiliently urged by a pusher against a common terminal. The pusher engages the central region of the blade and is displaced to either side of the common terminal by a switching operation for producing a seesaw motion of the movable contact member. The construction is such that the electrical contact with the first and second transfer terminals always occurs at a fixed, single point of the movable contact member, and no relative displacement is produced during the engagement of the movable contact member and the transfer terminals. As a consequence, if the contact therebetween becomes poor or dirt is present therebetween, a satisfactory electrical contact is no longer assured.

Therefore, it is an object of the invention to provide a toggle switch which is insusceptible to degradation of contact or interposition of dirt and maintains a satisfactory electrical contact.

It is another object of the invention to provide a toggle switch which assures an electrical contact between a movable contact member and a transfer terminal to be achieved at a pair of locations.

It is a further object of the invention to provide a toggle switch which is adapted to have the points of contact between the movable contact member and the transfer terminals readily displaced from each other slightly so as to permit them to be polished.

It is an additional object of the invention to provide a toggle switch having a movable contact member which engages with a transfer terminal at a varying location.

It is still another object of the invention to provide a toggle switch affording a clearly defined switching touch.

It is a still further object of the invention to provide a toggle switch having a plurality of sets, each including a common terminal, first and second transfer terminals and a movable contact member, and in which a reliable electrical contact is assured in each of the sets.

It is still additional object of the invention to provide a toggle switch having a point of contact which is insusceptible to degradation or to interposition of dirt to thereby maintain a satisfactory electrical contact and affording a clearly defined switching touch.

SUMMARY OF THE INVENTION

In accordance with the invention, the toggle switch comprises a casing including a bottom plate of an insulating material through which extend a common terminal as well as a first and a second transfer terminal located on the opposite sides thereof. A rod-shaped movable contact member is retained intermediate its length on the common terminal, and an interposing piece of an insulating material is disposed on the movable contact member. The casing also includes a top plate in which is mounted operating means, which can be operated to cause a seesaw motion of the movable contact member about the common terminal serving as a fulcrum for switching contact with the first and second transfer terminals alternately, which resiliently urging the movable contact member toward the common terminal through the interposing piece. Each of the transfer terminals is formed with a notch in its upper end, the opposing walls of the notch being tapered toward its bottom to receive the movable contact member therein. Thus, one end of the movable contact member is engaged with the both opposing walls of the notch in the transfer terminal, or an electrical contact is always achieved at a pair of points which are displaced from each other, thus maintaining a satisfactory contact. The interposing piece is formed with a longitudinal flute in which the movable contact member is received. V-shaped tabs are formed on at least the two sidewalls of the flute and engage with an annular groove formed in the periphery of the movable contact member at its central region. The movable contact member has a circular cross section in a plane transverse to the length thereof at least in its region where it engages with the transfer terminals. The common terminal has a pointed tip which is received within the groove in the movable contact member. In this manner, the movable contact member is retained on the common terminal so as to be capable of rotating about its longitudinal axis. For each switching operation, the movable contact member is rotated automatically, bringing all adjacent areas along the periphery of the contact portion of the movable contact member into contact with the transfer terminals, thus achieving an increased life of contact. The bottom surface of the longitudinal flute in the interposing piece is curved so as to be convex toward the movable contact member, so that when a pusher which resiliently urges the interposing piece is displaced to either side of the common terminal, the movable contact member is forced to experience a rapid seesaw motion, thus accomplishing a switching operation with a snap action or affording a clearly defined switching touch.

In a modificaiton, a plurality of sets, each comprising the common terminal, the first and second transfer terminals and the movable contact member, may be disposed side-by-side in a direction perpendicular to the direction of the array of these terminals. A common interposing piece may be provided for these movable contact members, which can be received within a plurality of longitudinal flutes formed therein. The bottom surface of the respective longitudinal flutes may be curved in the manner mentioned above to define a single point on the respective movable contact members for contact with the interposing piece, thereby assuring a reliable contact between the respective movable contact members and the associated transfer terminals even though the single interposing piece operates on the plurality of movable contact members.

DETAILED DESCRIPTION OF THE PREFERRED EMBODIMENTS

Figure 2:
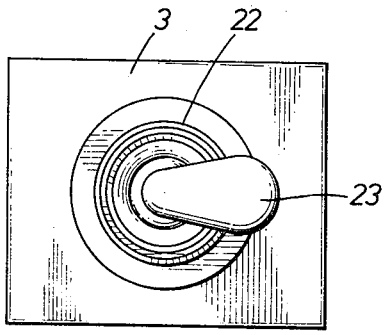
FIG. 2 is a top view.
Figure 1:
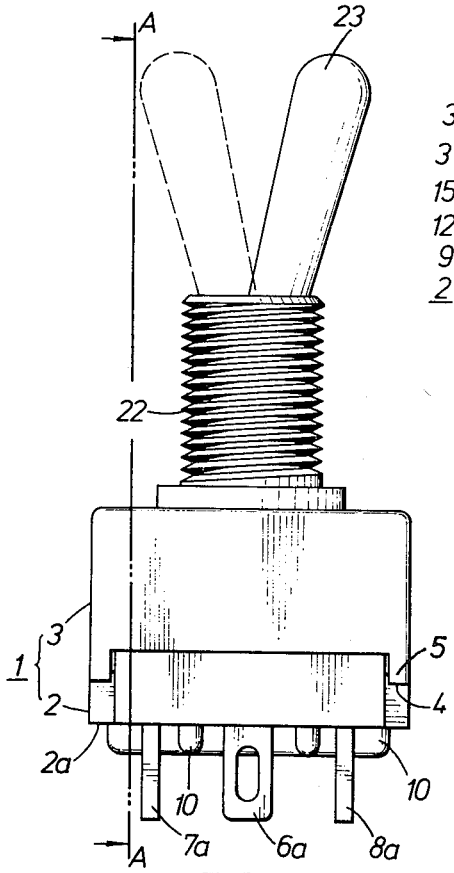
FIG. 1 is a front view of one embodiment of the toggle switch according to the invention.
Figure 3:
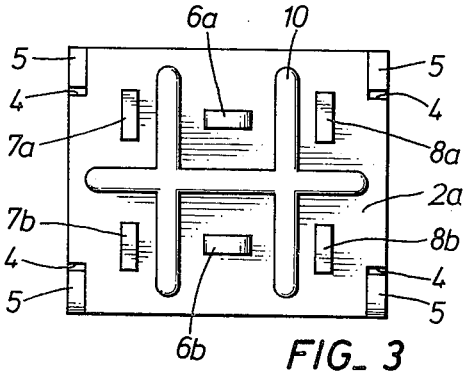
FIG. 3 is a bottom view.

Referring to FIGS. 1 to 5, the toggle switch according to the invention comprises a casing 1 which is substantially in the form of a parallelpiped, including a body 2 moulded from a synthetic resin material such as phenol resin and having a bottom plate 2*a*. A cover 3 formed of a metal such as stainless steel covers the open top of the body 2. The upper half of the body 2 is inserted into the cover 3, and four corners of the bottom surface of the body 2 are notched to form detent recesses 4, in which detent pieces 5 formed as an integral extension from the four corners of the bottom of the cover 3 are engaged by being folded, thus mechanically connecting the body 2 and the cover 3 together.

Figure 4:
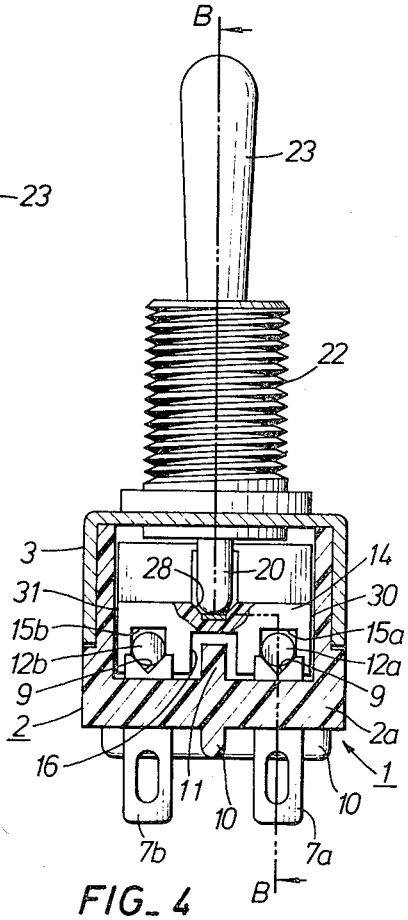
FIG. 4 is a cross section taken along the line A—A shown in FIG. 1.
Figure 5:
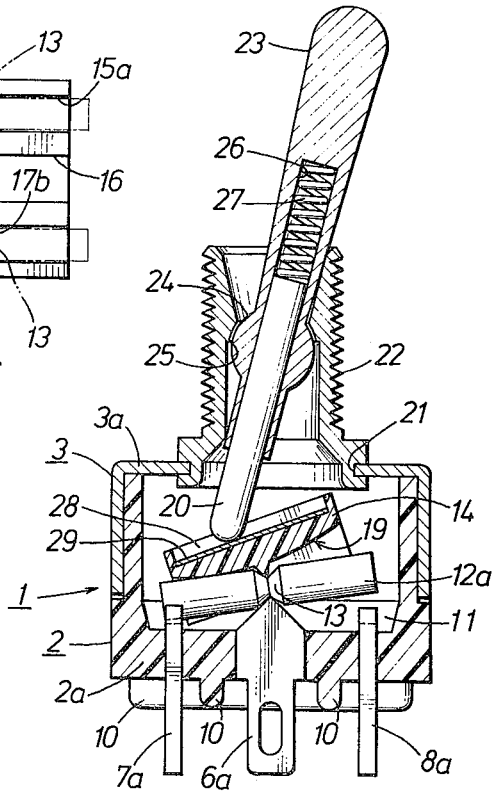
FIG. 5 is a cross section taken along the line B—B shown in FIG. 4.

A pair of common terminals 6*a*, 6*b* are disposed crosswise in the bottom plate of the casing 1, that is, in the bottom plate 2*a* of the body 2, at its central region, and extend therethrough. A pair of transfer terminals 7*a*, 8*a* are disposed on the opposite sides of the common terminal 6*a* and extend through the bottom plate 2*a*, and similarly a pair of transfer terminals 7*b*, 8*b* extend through the bottom plate 2*a* on the opposite sides of the common terminal 6*b*. Each of the common terminals 6*a*, 6*b* may comprises a silver plated, copper blade having its major surface located parallel to the direction along which the common terminal and the transfer terminals are arrayed (hereinafter referred to as the direction of array of terminals). As indicated in FIG. 5, the inner end of the respective common terminals is pointed in the form of a triangle. Each of the transfer terminals 7*a*, 7*b*, 8*a*, 8*b* may comprise a blade of silver alloy having its major surface located perpendicular to the direction of array of terminals. As indicated in FIG. 4, the inner end of the transfer terminals is formed with a notch 9 which is triangular in configuration in that the spacing between the opposing walls is narrowed toward the bottom plate 2*a*. On the lower surface of the bottom plate 2*a*, a separation rib 10 is integrally formed therewith in order to prevent degradation of the electrical insulation between adjacent terminals 6*a*, 6*b*, 7*a*, 7*b*, 8*a*, 8*b* as may be caused by accumulation of dirt, while a rib 11 extending along the direction of array of terminals is integrally formed on the inner surface of the bottom plate 2*a* between the terminals 6*a*, 6*b*.

A pair of rod-shaped movable contact members 12*a*, 12*b* are disposed on the common terminals 6*a*, 6*b*, respectively, for a seesaw motion thereon for switching contact with the transfer terminals 7*a*, 8*a* and 7*b*, 8*b*, alternately. The movable contact members 12*a*, 12*b* may comprise round silver rods, each formed with an annular groove 13 around the periphery of the central region. The pointed tip of the common terminals 6*a*, 6*b* is received in such groove 13 to permit an angular motion of the respective movable contact members 12*a*, 12*b* about the common terminals 6*a*, 6*b* serving as fulcrums, for switching contact with the transfer terminals, and also to permit a rotation of the respective contact members 12*a*, 12*b* on the common terminals about their respective axes. At least in the region where the contact members 12*a*, 12*b* engage the respective transfer terminals, they have a circular peripheral surface which is positioned within the v-shaped notch 9 in the transfer terminals to achieve an electrical contact therewith.

Figure 6:
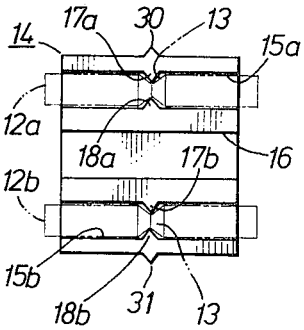
FIG. 6 is a bottom view of the interposing piece.

An interposing piece 14 of an insulating material is disposed on the movable contact members 12*a*, 12*b* in common thereto, and is formed with a pair of longitudinal flutes 15*a*, 15*b* in which the movable contact members are received. To avoid interference by the rib 11, the interposing piece 14 is also formed with a longitudinal flute 16 which is located opposite to rib 11. As indicated in FIG. 6, which is a bottom view of the interposing piece 14, a pair of V-shaped tabs 17*a*, 18*a* are integrally formed on the opposite sidewalls of the longitudinal flute 15*a* at a position which permit them to be received within the groove 13 formed in the movable contact member 12*a*. Similarly, a pair of V-shaped tabs 17*b*, 18*b* are integrally formed on the opposite sidewalls of the longitudinal flute 15*b* at a position which permits them to be received within the groove 13 formed in the movable contact member 12*b*. As further indicated in FIG. 5, each longitudinal flute 15*a*, 15*b* has a curved bottom surface 19 which is convex toward the movable contact members. The radius of curvature of the surface 19 is chosen on the order of 6 to 10 mm, for example.

A pusher 20 is resiliently urged against the interposing piece 14 from above to cause it into abutting engagement with the movable contact members, and is displaced to either side of the common terminal in response to an operation of operating means, thereby causing a seesaw motion of the movable contact members. To this end, a top plate 3*a* of the casing 1 is formed with a mounting opening 21, against the peripheral edge of which is secured as by crimping the lower end of a sleeve 22 so as to extend outwardly of the casing 1. An operating member 23 is inserted into the sleeve 22, and is integrally formed with a spherical fulcrum 24 intermediate its length, while a step 25 having a diameter less than that of the spherical fulcrum 24 is formed in the inner wall of the sleeve 22 intermediate its ends, permitting an angular motion of the operating member 23 with the fulcrum 24 engaging the step 25. A deep bore 26 is formed in the operating member 23 so as to extend from its lower end, and receives a coiled spring 27 as well as the upper end of the pusher 20, thus allowing the pusher 20 to be urged toward the interposing piece 14 by the spring 27. In its surface opposite to the pusher 20, the interposing piece is formed with a recessed groove 28 extending parallel to the direction of array of terminals for receiving the lower end of the pusher 20. Thus, when the operating member 23 is moved angularly to the left or right, the pusher 20 will be displaced toward the transfer terminals 7*a*, 7*b* or transfer terminals 8*a*, 8*b* relative to the common terminals 6*a*, 6*b* to cause the interposing piece 14 to assume an inclined position in which its either end is lowered, whereby the movable contact members 12*a*, 12*b* will be moved into contact with the transfer terminals 7*a*, 7*b* or transfer terminals 8*a*, 8*b*. A pair of weirs may be formed at the opposite ends of the recessed groove 28 to contain grease therein to permit a smooth sliding motion of the pusher 20 along the bottom surface of the recessed groove 28. Alternatively, the bottom surface of the recessed groove 28 may be provided with a metal plate 29 to further reduce the friction during such sliding motion. In order to locate the interposing piece 14 crosswise, the lateral sides of the interposing piece 14 are integrally formed with a pair of vertically extending projections 30, 31, as indicated in FIGS. 4 and 6, these projections being located in close proximity to or in a slight sliding contact with the adjacent inner walls of the body 2. The sleeve 22 is externally threaded for receiving a mounting nut thereon.

As mentioned above, with the toggle switch according to the invention, the operating member 23 may be operated to bring the movable contact members 12*a*, 12*b* into switching contact with either transfer terminals 7*a*, 7*b* or 8*a*, 8*b*. It is to be noted that since the movable contact members 12*a*, 12*b* engage with the opposite walls of V-shaped notch 9 in the transfer terminals and, an electrical contact is accomplished at a pair of points rather than at a single point as in the prior art, thereby achieving a more reliable contact. Because of the fact that the notch 9 provides a ramp surface for contact with the movable contact members and because of the mechanical chattering allowed, the movable contact members slide against the ramp surface of the notch 9 until they are firmly engaged within the notch 9 whereby these contacting ramp surfaces are maintained in a polished condition, thereby assuring a satisfactory electrical contact. For each switching operation, the movable contact members will slightly rotate about their axes and on the common terminals, so that in each region of the movable contact members where they engage with the transfer terminals and the common terminals, every portion on their peripheral surface come into play in turn, thus increasing the life of the contact in comparison to the life otherwise achieved. In the prior art practice, the movable contact member comprises a blade member, so that the electrical contact with transfer terminals occurs at a single, fixed point, and no contact-rubbing action is found. It will be readily appreciated that the switch according to the invention has a number of advantageous characteristics as compared therewith.

Another advantage of the invention accrues from the use of the interposing piece 14 for switching the movable contact members, which avoids the difficulty, experienced in the prior art blade-shaped movable contact member in controlling its movement by a pusher which directly engages it, attributable to the configuration of the movable contact member. While the provision of the interposing piece 14 reduces the distance between the fulcrum of rotation of the pusher 20 and the interposing piece 14, the presence of the curved surface 19 formed in the longitudinal flutes of the interposing piece 14 together with the action of the coiled spring 27 permits the interposing piece 14 to be rapidly turned as soon as the pusher 20 moves past and over the common terminals, thereby achieving a switching operation with a snap action. Where a plurality of sets, each including the common terminal, transfer terminals, and movable blade contact member are provided, the contact between the movable contact member and the longitudinal flute will take place along a line or surface without the provision of the curved surface 19, thereby resulting in a requirement for an increased mechanical accuracy in order to achieve a uniform contact of movable contact members with the transfer terminals. However, the presence of the curved surface 19 is effective to achieve contact between the movable contact member and the interposing piece at a single point, and because the interposing piece 14 is allowed to be angularly moved crosswise to a small extent, it is assured that the respective movable contact members are firmly moved into contact with the transfer terminals.

Figure 7:
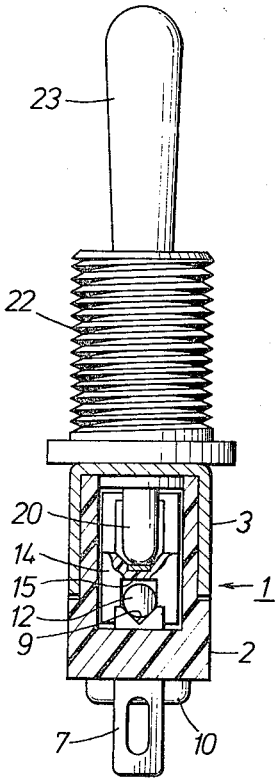
FIG. 7 is a cross section similar to FIG. 4 but illustrating another embodiment of the switch according to the invention.

It should be understood that the number of sets of the common terminal, transfer terminals and movable contact member is not limited to two as disclosed in the above embodiment, or alternatively only a single set may be provided as illustrated in FIG. 7. The control over the interposing piece 14 may be achieved by means other than the operating member 23, provided it is assured that the pusher 20 be displaced to either side of the common terminal while resiliently wiping it against the interposing piece 14. In view of the fact that the movable contact member is engaged with the notch 9 in the transfer terminal to achieve an electrical contact at a pair of points, it is not essential that the movable contact member be capable of rotating about its axis. Thus, the movable contact member may be shaped as a blade instead of a round rod.

Having described the invention, what is claimed is:

1. A toggle switch comprising a casing having a bottom plate fabricated of insulating material, a common terminal extending through said bottom plate of the casing, a first and a second transfer terminal extending through said bottom plate on opposite sides respectively of the common terminal, an elongated rod-shaped movable contact member supported within the casing on said common terminal, the central region of said elongated movable contact member being so placed on the common terminal that said movable contact member is capable of rotation about its axis of elongation, the point of support of said movable contact member on said common terminal serving as the fulcrum for a seesaw motion of the movable contact member for switching contact of longitudinally spaced regions of said movable contact member with the first and the second transfer terminals respectively, an interposing piece of an insulating material disposed on the movable contact member, operating means carried by a top plate of the casing for imparting a seesaw motion to the movable contact member, said operating means including means for resiliently urging the interposing piece toward the common terminal, and a notch formed in the upper end of each of the transfer terminals, each of said notches having a tapered spacing between its opposite walls between which one of said longitudinally spaced regions of the movable contact member is received, each of said longitudinally spaced regions of said movable contact member being substantially circular in cross section to effect a sliding engagement between each of said longitudinally spaced regions and the opposite walls of its associated tapered notch when said switching contact is effected, said sliding contact being operative to polish the interengaging surfaces of siad movable contact member and notch and being further operative to effect an incremental rotation of said movable contact member about its axis of elongation as two spaced points on each of said longitudinally spaced regions move into engagement with the opposite walls of the associated tapered notch respectively.

2. A switch according to claim 1 wherein a longitudinal flute is formed in the interposing piece for receiving the movable contact member, at least one pair of V-shaped tabs formed on the opposite sidewalls of the longitudinal flute, a V-shaped groove formed around the periphery of the movable contact member at its said central region, said tabs extending into said groove for positioning said movable contact member in said flute, and said common terminal having a pointed tip which also extends into the groove in spaced relation to said tabs and cooperating with said tabs to support said movable contact member for said rotation about its axis of elongation.

3. A switch according to claim 1 in which the interposing piece has a lengthwise curved surface opposite to the movable contact member, the curved surface being convex thereto.

4. A switch according to claim 1, further including a recessed groove formed in the surface of the interposing piece which is located away from the movable contact member so as to extend substantially parallel to the length of the movable contact member, and a pusher inserted into the recessed groove and resiliently urged to engage the bottom surface thereof, the pusher being operated by said operating means to slide along the recessed groove lengthwise thereof.

5. A switch comprising a casing having an insulating bottom wall, a common terminal, first and second transfer terminals located on the opposite sides of said common terminal, said terminals extending through and being secured to said insulating bottom wall, the portion of said common terminal within said casing having a pointed tip, an elongated rod-shaped movable contact member having a grooved central region which receives the pointed tip of said common terminal for supporting said movable contact member within the casing on the common terminal, the point of support serving as a fulcrum for a seesaw motion of the movable contact member for switching contact with the first and the second transfer terminals, an interposing piece of an insulating material disposed on the movable contact member, operating means carried by a top plate of the casing, said operating means including pusher means in slidable engagement with and along an elongated region extending lengthwise of said movable contact member on the side of said interposing piece remote from said movable contact member for imparting a seesaw motion to the movable contact member, said operating means also including means for resiliently urging the interposing piece toward the common terminal, and a convexly curved surface formed lengthwise along the interposing piece on the side thereof facing the movable contact member.

6. The structure of claim 5 wherein said switch has a plurality of contact sets each of which includes a common terminal, a first and a second transfer terminal and a movable contact member, said plurality of contact sets being disposed in a direction perpendicular to the direction of array of terminals, and a common interposing piece for the movable contact members of the sets.

7. The structure of claim 6 in which a plurality of longitudinal flutes are formed in the interposing piece for receiving the respective movable contact members.

* * * * *